United States Patent [19]

Raz

[11] Patent Number: 4,570,420

[45] Date of Patent: Feb. 18, 1986

[54] METHOD AND APPARATUS FOR CLOSING AND STACKING BOXES

[75] Inventor: Omri Raz, Hagalil Hamaaravi, Israel

[73] Assignee: Eshet Eilon, Hagalil Hamaaravi, Israel

[21] Appl. No.: 593,888

[22] Filed: Mar. 27, 1984

[51] Int. Cl.[4] ..... B65B 7/28

[52] U.S. Cl. ..... 53/485; 53/287; 53/312; 53/541

[58] Field of Search ..... 53/242, 243, 255, 258, 53/262, 281, 287, 293, 294, 306, 310, 312, 443, 484, 485, 541

[56] References Cited

U.S. PATENT DOCUMENTS

| | | | |
|---|---|---|---|
| 1,080,277 | 12/1913 | Harbeck | 53/294 |
| 2,433,701 | 12/1947 | Linstedt | 53/294 |
| 2,669,377 | 2/1954 | Van Poolen et al. | 53/367 |
| 2,850,858 | 9/1958 | Daly et al. | 53/367 |
| 3,138,905 | 6/1964 | Ellinger | 53/485 |
| 3,501,895 | 3/1970 | Geyer | 53/287 |
| 4,006,575 | 2/1977 | Lee | 53/484 |
| 4,459,791 | 7/1984 | Booth | 53/312 |

*Primary Examiner*—Robert L. Spruill
*Assistant Examiner*—Richard Mudd
*Attorney, Agent, or Firm*—Benjamin J. Barish

[57] ABSTRACT

A method of closing boxes in which the open-ended boxes and covers are sequentially fed to a box-closing station with the top of each cover overlying the open end of the box. Fitting-leaves are interposed between the outer face of the open end of the box, and the inner face of the peripheral side wall of the cover, while relative movement is effected between the cover and the box towards each other, such as to fit the cover over the open end of the box. The apparatus includes a lift which raises the box into fitted engagement with the cover supported on the fitting-leaves at the box-closing station.

12 Claims, 14 Drawing Figures

FIG. 1
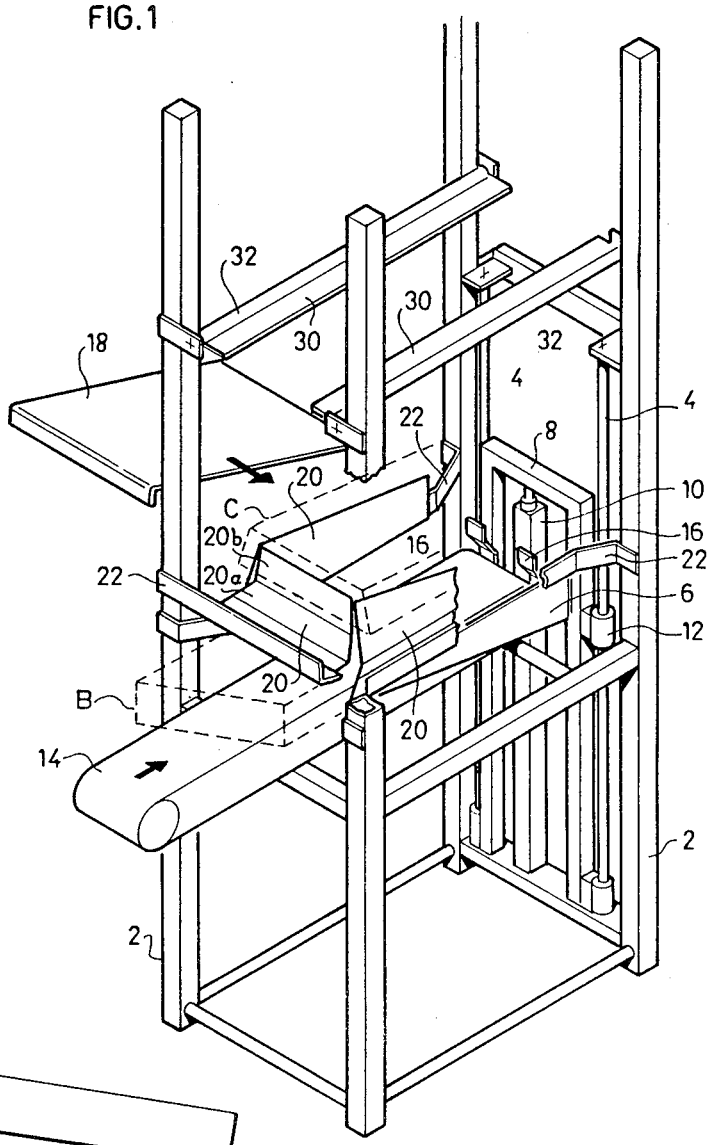
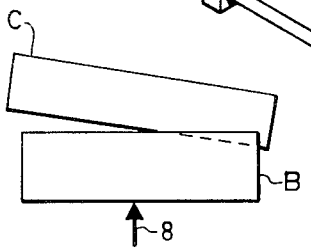
FIG. 2

METHOD AND APPARATUS FOR CLOSING AND STACKING BOXES

BACKGROUND OF THE INVENTION

The present invention relates to a method and apparatus for closing and stacking boxes, such as boxes made of cardboard and filled with produce before being closed and stacked.

A number of procedures are now used for filling, closing and stacking boxes in an automated production-line system. However, one of the problems in the known procedures is closing the filled box with the cover in a manner which is efficient, reliable and not apt to damage the contents of the box. The techniques commonly used for this purpose usually involve pressing the upper end of the box inwardly, or pressing the sides of the cover outwardly, in order to apply the cover over the box. However, this technique does not always assure that the upper end of the box will be received within the cover, particularly at the more rigid corners of the box. In addition, the former procedure may damage the contents of the box at its upper end, particularly if the contents are delicate or fragile, such as some forms of produce.

SUMMARY OF THE INVENTION

An object of the present invention is to provide a novel method, and also a novel apparatus, for closing the boxes in an efficient and reliable manner and without danger of damaging the contents of the box. A further object of the invention is to provide a novel method and apparatus which may be used not only for efficiently closing the boxes, but also for efficiently stacking them as a part of the closing operation.

According to a broad aspect of the present invention, there is provided a method of closing open-ended boxes of rectangular configuration with covers of corresponding configuration characterized in sequentially feeding the open-ended boxes to a box-closing station; sequentially feeding covers to said box-closing station, each of which covers has a top wall and a peripheral side wall and is fed such that its top wall overlies the open end of the box at the box-closing station; interposing fitting-leaf means between the outer face of the open end of the box and the inner face of the peripheral side wall of the cover aligned therewith at the box-closing station, while effecting relative movement between the cover and the box towards each other to fit the cover over the open end of the box as guided by said fitting-leaf means; and withdrawing said fitting-leaf means from between the side wall of the cover and the box closed thereby. The fitting-leaf means includes leaves extending along three sides of the box, and the relative movement between the box and cover is effected while the cover is at an incline with respect to the box such that the open end of the box is first received within the cover from the fourth side of the box not provided with a fitting leaf.

In the preferred embodiment of the invention described below, the relative movement between the cover and the box at said box-closing station is effected by raising the box into fitted engagement with the cover.

In addition, the box, with the cover thereon, is further raised out of the box-closing station to withdraw the fitting-leaf means from between the box and cover, and to bring the box and cover to an overlying shelf constituting a box-stacking station.

The invention also provides apparatus for closing the boxes with covers and also for stacking them in accordance with the above-described method.

As will be more apparent from the description below, the novel method and apparatus assure that the box covers will be fitted onto the open ends of the boxes in an efficient and reliable manner and without danger of doing damage to the box contents. In addition, each box is automatically stacked at the end of the box-closing operation performed on it.

Further features and advantages of the invention will be apparent from the description below.

BRIEF DESCRIPTION OF THE DRAWINGS

The invention is herein described, by way of example only, with reference to the accompanying drawings, wherein:

FIG. 1 is a three-dimensional view, partly broken away, illustrating one form of apparatus constructed in accordance with the present invention;

FIG. 2 diagrammatically illustrates the manner of inserting the box into the respective cover during the operation of the apparatus of FIG. 1.

DESCRIPTION OF A PREFERRED EMBODIMENT

Figure 3:
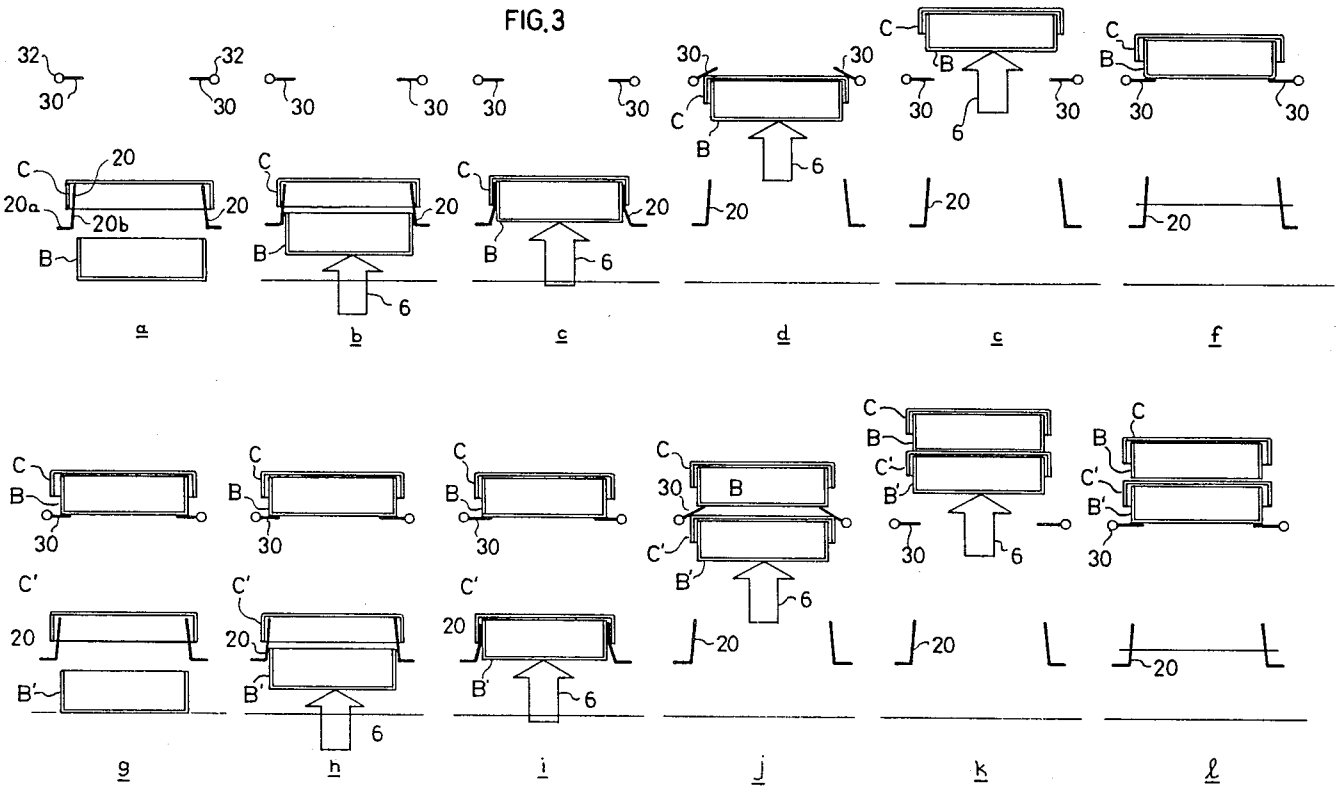
FIGS. 3*a* through 3*l* illustrate the sequence of steps involved in the closing and stacking of each box when using the apparatus of FIG. 1.

The apparatus illustrated in the drawings is for use in closing rectangularly-shaped boxes, fragmentally indicated by the phantom lines B in FIG. 1, with rectangularly-shaped covers, fragmentally indicated by the phantom lines C in FIG. 1, and stacking the closed boxes in a vertical stack immediately after their closing. Both boxes B and covers C may be made, for example, of cardboard or other deformable material such as plastic. Each box is initially open at its upper end and filled with, e.g., produce, and each cover is constituted of a top wall and a peripheral side wall adapted to be applied over the open end of the filled box to close it.

With reference to FIG. 1, there is illustrated an apparatus including a framework, generally designated 2, supporting a pair of spaced vertically-extending rods or rails 4. These rods guide the vertical movement of a table 6 fixed to a lift 8, in the form of a U-shaped member, which lift is reciprocated in the vertical direction by a piston-and-cylinder reciprocating motor, e.g., an air cylinder 10, the reciprocations of the lift and its table 6 being guided by sleeves 12 receiving the rods 4. Table 6 is partly broken-away in FIG. 1, to show an underlying conveyor belt 14 which sequentially feeds the boxes B to be closed, onto the table 6 and against stops 16 at the inner end of the table.

The covers applied to the boxes are sequentially fed by another conveyor 18 onto a plurality of fitting leaves 20 overlying the table 6, when the latter is in its normal lower position illustrated in FIG. 1.

In the embodiment illustrated in FIG. 1, there are three such fitting leaves 20, each one being of spring metal, for example, and secured to a bracket 22 fixedly mounted to frame 2. The three fitting leaves 20 are thus aligned with all the sides of the box B except for the inner side adjacent to the lift 8, the latter side not requiring such a fitting leaf for reasons to be more particularly described below.

Each of the three fitting leaves 20 includes an outer substantially horizontal portion 20*a* which is fixed to its respective mounting bracket 22, and an inner portion 20*b* which is of a smooth surface on both its faces and extends substantially vertically with respect to the box-supporting table 6 but inclined slightly inwardly towards the center of the table.

Overlying the box-supporting table 6 and the three cover-supporting leaves 20 are a pair of strips 30 pivotably mounted at 32 to the frame 2. The two strips 30 are each pivotable in one direction, namely, the upper direction but not in the lower direction. They are spaced from each other a distance slightly greater than the cover width so as to permit a box B including its cover C, to be raised between the strips, causing them to pivot for this purpose, and then to be released on top of the strips, whereupon the strips thereafter support the box and its cover. The strips 30 thus constitute a shelf for supporting each box after its cover has been applied. In operation, the two strips 30 support the stack of boxes after their covers have been applied, and thus constitute a stacking station, as will be described more particularly below.

During the operation of the apparatus, each box B is fed via its conveyor 14 onto table 6, and a cover C is fed at the same time via its conveyor 18 onto the three fitting leaves 20 overlying the open end of the box. Cylinder 10 is then actuated to raise lift 8 and table 6, including the box carried thereby, with respect to the cover C on the fitting leaves 20. The latter leaves are thus effective, not only to support the cover in the box-closing station, but also to fit each side of the cover over the respective side of the box when the box is raised into the cover, this fitting being effected by slightly pressing inwardly the respective side of the box and/or pressing outwardly the respective side of the cover. The fitting leaves 20 thus assure that the cover C will be applied over the open end of the box in a smooth, efficient and reliable manner without damaging the contents at the upper end of the box.

Table 6 carrying the box is further raised by air cylinder 10 to lift the box, including the cover thereon, first to be released from the fitting leaves 20, and then to pass between the two shelf elements 30, the latter pivoting for this purpose. After the box is thus raised to overlie the shelf elements, the table is lowered by the air cylinder 10, whereupon the shelf elements engage and support the bottom of the box.

As indicated earlier, only three fitting leaves 20 are required even though both the box and the cover applied thereto are of rectangular (four-sided) configuration. This is because the fitting leaves 20 are disposed so as to support the cover C received thereon at an incline with respect to the box B on table 6 in the box-closing station. This incline is such that, as schematically shown in FIG. 2, when the box is raised within the cover, the inner end of the box (namely that adjacent to the lift 8) is first received within the cover before the opposite end of the box, so that a fitting leaf at that inner end of the box is not necessary to assure the fitting of all four sides of the cover onto the box.

The operation of the apparatus illustrated in FIG. 1 will now be more particularly described with respect to the sequence of steps illustrated in FIG. 3.

Thus, FIG. 3*a* illustrates the initial condition wherein one box B and one cover C have both been fed to the box-closing station, namely, box B being supported on table 6 and cover C being supported on the fitting leaves 20.

Air cylinder 10 is now actuated to raise lift 8 and table 6, thereby raising box 8 towards cover C, whereupon the fitting leaves 20 direct or fit the sides of the cover onto the open end of the box (FIG. 3*b*). Table 6 continues to rise by the air cylinder 10 (FIG. 3*c*), whereupon both the box B and cover C are lifted out of engagement with the fitting leaves 20 and are moved upwardly through the shelf elements 30, the latter shelf element pivoting (FIG. 3*d*) to permit the passage therethrough of the box and cover. When the box and cover are in their uppermost positions above the shelf elements 30 (FIG. 3*e*), table 6 is lowered by air cylinder 10, whereupon the box and cover are supported by the shelf elements 30 (FIG. 3*f*).

The operation is now repeated with the next box B′ and cover C′ fed by conveyors 14 and 18, respectively, to the box-closing station, the box B′ being supported on table 6 and the cover C′ being supported on fitting leaves 20 (FIG. 3*g*). The table 6 is again moved upwardly by the air cylinder 10 to fit the cover C′ over the box B′ (FIG. 3*h*), and to raise both box and cover (FIG. 3*i*) towards and through the shelf elements 30, which shelf elements again pivot upwardly (FIG. 3*j*) to permit the passage of the second box B′ and cover C′ therethrough. This continued upward movement of the table 6 thus causes the second box B′ and cover C′ to raise the first box B and cover C supported on the shelf elements 30 (FIG. 3*k*), the weight of the first box thereby assuring a secure fit of the second cover onto the second box.

Table 6 is then lowered, whereupon the shelf elements support the two boxes in a vertical stack (FIG. 3*l*).

The next succeeding box is then fed to the box-closing station, covered by its cover fed onto the fitting leaves 20, and stacked in the same manner as described above, and so on, for as many boxes as are to be stacked on shelf elements 30.

It will thus be seen that the apparatus not only assures smooth, efficient and reliable closing of the boxes with a minimum possibility of damage to the contents of the boxes, but also effects the stacking of the boxes automatically at the end of each box-closing operation. Moreover, the weight of the stack is applied to the cover of each succeeding closed box, thereby assuring firm closing of the boxes.

While the sequence of steps illustrated in FIG. 3 shows the cover in a substantially horizontal position when applied to the box, it will be appreciated that the cover is shown in this manner for simplification purposes, and that actually the cover would be in an inclined position as illustrated in FIG. 2 when applied to the box.

Also, while the invention has been described with respect to one preferred embodiment, it will be appreciated that many other variations, modifications and applications of the invention may be made.

What is claimed is:

1. A method of closing open-ended boxes of rectangular configuration with covers of corresponding compensation, characterized in:

sequentially feeding said boxes to a box-closing station;

sequentially feeding said covers to said box-closing station, each of which covers has a top wall and a peripheral side wall and is fed such that its top wall overlies the open end of the box at the box-closing station;

interposing fitting-leaf means between the outer face of the open end of the box and the inner face of the peripheral side wall of the cover aligned therewith at the box-closing station, while effecting relative movement between the cover and the box towards each other to fit the cover over the open end of the box as guided by said fitting-leaf means;

said fitting-means including leaves extending along three sides of the box, and the relative movement between the box and cover being effected while the cover is at an incline with respect to the box such that the open end of the box is first received within the cover from a fourth side of the box not provided with a fitting leaf; and withdrawing said fitting-leaf means from between the side wall of the cover and the box closed thereby.

2. The method according to claim 1, wherein the relative movement between the cover and the box at said box-closing station is effected by raising the box into fitted engagement with the cover.

3. The method according to claim 2, wherein the box, with the cover thereon, is further raised out of the box-closing station to withdraw the fitting-leaf means from between the box and cover, and to bring the box and cover to an overlying shelf constituting a box-stacking station.

4. Apparatus for closing boxes with covers comprising:

box feeding means for sequentially feeding open-ended boxes of rectangular configuration to a box-closing station;

cover feeding means for sequentially feeding covers to said box-closing station, each of which covers has a top wall and a peripheral side wall, and is fed such that its top wall overlies the open end of the box in said box-closing station;

drive means for effecting relative movement between the box and the cover towards each other; and fitting-leaf means disposed such as to be interposed between the outer face of the open end of the box and the inner face of the peripheral side wall of the cover while the relative movement is effected between the cover and the box towards each other to fit the cover over the open end of the box;

said fitting-leaf means comprising three fitting-leaves, one extending along each of three sides of the box;

and means mounting said fitting-leaf means to support the cover over the box in the box-closing station at an incline with respect to the box, such that when the drive means raises the box towards the cover, a fourth side of the open end of the box not provided with a fitting-leaf is received within the open end of the cover before the opposite side of the box.

5. Apparatus according to claim 4, wherein the fitting-leaf means are disposed so as to support the cover over the box in the box-closing station.

6. Apparatus according to claim 5, wherein said drive means comprises a lift which raises the box into fitted engagement with the cover supported on said fitting-leaf means at said box-closing station.

7. Apparatus according to claim 6, further including a shelf overlying said cover and box in the box-closing station, said shelf constituting a box-stacking station for forming and supporting a stack of boxes as each, with a cover applied thereto, is raised by said drive out of the box-closing station.

8. Apparatus according to claim 7, wherein said shelf is constituted of a plurality of shelf elements overlying the box-closing station, said shelf elements being pivotably mounted to permit the box and cover to pass therethrough when raised by said drive out of the box-closing station, and including supporting surfaces engaging the bottom of the lowermost of the stack for supporting the stack when the drive lowers the stack onto the shelf elements.

9. Apparatus according to claim 8, wherein said shelf elements are in the form of a pair of pivotably-mounted strips aligned with two opposite sides of the box.

10. Apparatus according to claim 4, wherein said box-feeding means comprises a first conveyor belt.

11. Apparatus according to claim 10, wherein said cover feeding means comprises a second conveyor belt.

12. Apparatus according to Chamber 4, wherein said drive comprises a reciprocating piston-and-cylinder reciprocating fluid motor.

* * * * *